US005421857A

United States Patent [19]

Marteanenko et al.

[11] Patent Number: 5,421,857

[45] Date of Patent: Jun. 6, 1995

[54] METHOD FOR OBTAINING METALS, THEIR COMPOUNDS, AND ALLOYS FROM MINERAL RAW MATERIALS

[76] Inventors: Vaecheslav M. Marteanenko, Shkolniey Bulvar, Dom 7, kv. 26, 142432 Ryssuam Nisjivsjata Ibkastm Bigubsjt raion Poseolok Chernogolovka, Russian Federation; Vitaly M. Maslov, Shkolniey Bulvar, Dom 14, kv. 210, 142432 Russia, Moskovskaya Oblast, Noginsky raion Poseolok Chernogolovka, Russian Federation; Emil A. Shtessel, 301 Heights La., Apt. 29C, Feasterville, Pa. 19047; Michail A. Berenshteyn, 12403 Braxfield Ct., Apt. 15, Rockville, Md. 20852

[21] Appl. No.: 209,388

[22] Filed: Mar. 10, 1994

[30] Foreign Application Priority Data

Nov. 30, 1992 [RU] Russian Federation ..... 92009162

[51] Int. Cl.[6] ..... C22C 39/14

[52] U.S. Cl. ..... 75/707; 75/458

[58] Field of Search ..... 75/707, 537, 567, 569

[56] References Cited

U.S. PATENT DOCUMENTS 3,791,819 2/1974 Loutzenhiser ..... 75/458

*Primary Examiner*—Peter D. Rosenberg

*Attorney, Agent, or Firm*—Amster, Rothstein & Ebenstein

[57] ABSTRACT

In this method for obtaining metals, their compounds, and alloys from mineral raw materials a burden is prepared by mixing a comminuted raw material with additions of chemical elements taken from the chemical composition of the starting raw material, oxidizing roasting is then carried out accompanied by evacuating and utilizing gaseous oxides, and a reduction process proceeds followed by separation of metals and their compounds. According to the invention, in the course of preparing the burden compounds of the above chemical elements containing oxygen are added to the mixture at a ratio of the compounds to the chemical elements ranging from 1:1 to 1:100 and at a total quantity of additions in the burden at least 5%. The oxidizing roasting process proceeds in an oxygen-containing atmosphere at a temperature from 1400° to 1600° C. followed by cooling and comminuting solid oxides obtained. Prior to metallothermy these oxides are mixed with a reducing metal being used at a ratio of the total of oxides of the metals obtained, alloys to the reducing metals ranging between 1:0.3 and 1:0.7. Reduction process proceeds at a temperature 2000° to 2300° C.

1 Claim, No Drawings

METHOD FOR OBTAINING METALS, THEIR COMPOUNDS, AND ALLOYS FROM MINERAL RAW MATERIALS

CROSS-REFERENCE TO RELATED APPLICATION

This is a continuation of International Application PCT/RU93/00140 with an international filing date of Jun. 23, 1993, now abandoned.

FIELD OF THE INVENTION

This invention relates to metallurgy, and more particularly to a method for obtaining metals, their compounds and alloys from mineral raw materials, such as from sulfide ore concentrates.

BACKGROUND OF THE INVENTION

One problem, outstanding in the world metallurgical practice, is a comprehensive wastefree reprocessing of industrial iron-containing refuse, pyrite cinder of ore concentrates, and especially flotation and magnetic separation tailings of sulfur-bearing ores of iron and other metals. These tailings and concentrates contain compounds of manganese, cobalt, vanadium, titanium, chromium, nickel and some other metals in amounts below 4-1%, as well as rare-earth and trace elements. Until now tailings, although being a valuable complex raw material, were not reprocessed and went to waste in hundreds of millions of tons to occupy large surface areas and foul the environment.

There is known a method of recovering a valuable metal from a lump material containing this metal and elementary sulfur. In the course of recovering the metal the lump material is heated to 140°-170° C., cooled to less than 90° C., and subjected to extraction with tetrachloroethane. Then the solid fraction is separated from liquid. Used as a starting material is slime formed as a result of nickel electrolysis. Nickel matte is used here as the anode.

However, this method is not suitable for reprocessing sulfur-bearing ores, because hydrometallurgical process are hazardous for the environment and require large quantities of water.

There is also known a method for reprocessing sulfide ores containing up to 60% iron, which invovles oxidizing roasting of the ores at a temperature below 750° C. However, this method is not adaptable to roasting lean ores. In addition, because of high content of sulfur in the calcine, solid products of roasting (iron oxides) are of little use for further processing. Also widely used in metallurgy for obtaining metals and their compounds are thermal reduction methdos, for example, ones based on the reduction by aluminum. According to one such method, metal oxides are reduced by aluminum in an exothermic reaction at a temperature of 2400°-2500° C. to elementary metals and aluminous slag. The aluminous slag can be melted and easily separated from the metal. It should be noted, however, that this method is not suitable for processing sulfur-bearing minerals due to the presence of sulfur therein.

One more promising method involves aluminothermic reduction of oxides of reactive metals (Ti, Nb, Ta, Zr, Hf, Mo, Cr, V) by melting the meatl inside an induction furnace, and adding thoroughly mixed granules of reagents containing CaO oxide. Electric power applied to the melt is controlled so as to maintain a temperature exceeding the preset minimum. Reduction process per se proceeds in an inert atmosphere of argon (cf., GB, A 1,475,781).

However, this method is not suitable for reprocessing sulfur-bearing minerals, becuase of the presence of sulfur which tends to form sulfides with the metal. Also, without an extra source of heat (induction heating) this method fails to separate metal and slag after the exothermic reduction reaction.

A method which bears the closest resemblance to the one to be claimed herein in terms of its technical essence and results obtainable is disclosed in JP, A, 49-42,761. This prior art method teaches a direct and dry processing of enriched sulfide ore by directly charging a sulfide concentrate mixed with copper, lead, zinc and iron into a melt present in a furance. Then the concentrate is mixed with air, oxygen, or a mixture of air and oxygen, for the mixture to be oxidized and melted. Outgoing gases carrying sulfur dioxide are evacuated. The thus obtained melt is mixed with a reducing agent, such as coke and air, oxygen, or a mixture thereof. The outgoing gases carrying zinc and lead obtained during the reduction process are sulimated to separate the metals from the melt, and the sublimating agent, such as chloride, or air, or oxygen, or a mixture thereof, is mixed with the remaining melt. The process results in a melt containing iron and outgoing gases carrying copper and negligible quantities of lead and zinc.

However, the products of reduction contain carbon monoxide generated when oxides are liberated from coke. In addition, the thus recovered iron has a poor quality because it is contaminated with copper, lead, and zinc. Another disadvantage of this prior art method is the impossibility to reprocess tailings which are poor in iron, but contain numerous inert oxides of silicon, magnesium, and calcium, because the process requires higher temperatures and higher rates of heat flow from an external heat sources, and necessitates the use of a reducing agent other than carbon.

SUMMARY OF THE INVENTION

The present invention aims at the provision of a method for obtaining metals, their compounds and alloys from a mineral raw material characterized by a complete, comprehensive and waste-free reprocessing of the raw material, reduced hazard to the environment, and minimized consumption of power thanks to utilizing the heat of exothermic reactions.

The aim of the invention is attained in a method for obtaining metals, their compounds and alloys from a mineral raw material involving the preparation of a burden by mixing the comminuted raw material with additive including chemical elements selected from the chemical composition of the starting material, carrying out oxidizing roasting accompanied by evacuating and utilizing gaseous oxides, and carrying out a reduction process with subsequent separation of metals and their compounds, according to the invention, in the course of preparation of the burden the compounds of said chemical elements containing oxygen are added to the mixture at a ratio of these compounds to the chemical elements ranging from 1:1 to 1:100 and at a total proportion of additions in the burden at least 5%, whereas the oxidizing roasting is carried out in an oxygen-containing atmosphere at a temperature from 1400° to 1600° C. followed by cooling and comminuting the resulting solid oxides; prior to the metallothermic process these oxides are mixed with the reducing metal being used at a ratio of the total of metal oxides, alloys to the reducing metal ranging from 1:0.3 to 1:0.7; the reduction process per se proceeding at a temperature between 2000° and 2300° C., The herein proposed method allows to ensure a virtually complete and waste-free processing of any mineral iro-containing raw material. The method is ecologically friendly, and can save substantial amounts of power thanks to utilizing the heat of exothermal process liberated by chemical reactions.

The essence of the invention resides in the following. The process can be viewed as two successively linked stages (viz, oxidation and reduction stages). The two stages are accompanied by liberation of substantial amounts of heat thanks to chemical interaction between the burden components. The start of the process coincide with the action of an external factor, such as a heating coil (thermal pulse) across the burden at a rate of 0.05 to 12 mm/sec, and proceeds in layers. The intermediate product of the first stage, viz, a combination of solid oxides, cannot be utilized because it has such "harmful" impurities present in the starting material or tailings as arsenic, zinc, tin, and lead. However, after the second stage, reduction, such as aluminothermy, which proceeds at a high temperature in the atmospheric air, the elements of the addition are sublimated, oxidized, and slagged off as the reducing metal, particularly corundum, with the properties thereof unaffected. An ingot of the metal, or its alloy, which is also formed in the second stage, more specifically, a ferroalloy, is refined whereby the residue contains only ferrosilicon alloyed with aluminum, manganese, nickel and chromium, and modifying additions including traces of rare-earth metals and trace elements.

It has to be stated that the two said stages are associated by the chemistry of the process. More specifically, the quantity of additions used in the first stage determines not only the temperature and composition of products (oxides) in this stage, but also the temperature within the preset temperature range of 2000°–2300° C. in the second stage of the process with the aforedescribed relationship between the oxides obtained and reducing metal (aluminum) ranging from 1:0.3 to 1:0.7, and, consequently, the optimized composition of the products of the second stage and their separation in the liquid state.

Used as the additions in the stage of oxidizing roasting are the chemical elements taken from the chemical composition of the starting material. These elements can include iron, aluminum, magnesium, titanium, calcium, silicon, or their mixtures in various proportions. It is most practicable to use powdered iron, or powdered wastes of case iron and steel.

The second component of the addition is generally a compound based on the elements included in the chemical composition of the raw material containing active oxygen which is liberated in response to heating. It is used to ensure 100% oxidation of all the components present in the starting material.

Barium, sodium, calcium peroxides, and magnetites can be used as these compounds. The products of the first stage, viz, those resulting from the oxidizing roasting, are most preferable for use as the addition. These products include magnetite to promote the oxidation process, and to optimize composition of the burden for the second stage of the process.

The range of parameters of the proposed method is determined by the following considerations. Reduction in the quantity of the addition to below 5% leads to termination of roasting in the oxidation stage of the process.

An increase in the ratio between the chemical element and oxygen-containing compound to below 100:1 leads to imcomplete sulfur combustion. Conversely, a reduction in this ratio to less than 1:1 results in temperature increase over 1600° C. and deteriorated quality of products due to "deadbum" sintering. The choice of temperature range in the first stage is determined by optimized composition of the products of roasting. A reduction in this temperature to below 1400° C. leads to incomplete combustion, whereas a temperature higher than 1600° C. results in excessive sintering of the products and incomplete combustion.

In the second stage of the process variations in the ratio between the components to over and below the specified range lead to that the process of phase separation tends to die down, because the temperature of the process falls below the melting point of the components, or the melt becomes enriched in the light-fraction ingredient in case of an excess in the quantity of the reducing metal. Reduction in the process temperature below 2000° C. causes the process to die down, whereas a temperature higher than 2300° C. makes the process very vigorous, and can lead to completed ejection of the reaction mass from the autoclave.

Research has shown that the method can utilize lean ores, industrial wastes, and the like, which allows to reduce the surface areas occupied by dumps, waste disposal areas, and slime ponds (the estimates show a reduction by 10,000–100,000 t/yr). The technology offered by the method also allows to reduce the amount of energy consumed for the end product to 40 kWh per 1 ton. Experiments have demonstrated that waste materials can be successfully turned into products of industrial importance (corundum, ferrosilicon alloyed with additions of nonferrous metals).

BEST MODE OF CARRYING OUT THE INVENTION

The method of the invention is carried out in the following manner. Tailings of magnetic separation of iron ore are dried and comminuted. A burden is prepared from the thus obtained powder material by mixing it with additions. The additions are preselected from the elements included in the chemical composition of the starting raw material. It is preferable to use iron powder or powdered cast iron wastes. Another addition ingredient is a compound also taken from the chemical composition of the starting raw material and containing active oxygen (oxygen-containing compound). Normally, it is part of the product of the oxidation stage recyclable into the process and containing magnetite decomposable into a lower oxide and active oxygen in response to heating. The quantity of the addition in the burden should be at least 5% by mass.

After mixing the burden containing tailings and additions is placed in an oxygen-containing atmosphere of an autoclave, and the heating coil is energized to initiate an exothermal reaction. Combustible components of the tailings, such as iron sulfides and material of the addition, particularly iron powder, take part in the reaction. Circulating oxygen and the second component of the addition act here as oxidizing agents. Combustion proceeds at a rate of about 0.05 mm/s and a temperature ranging from 1400° to 1600° C.

The reaction is accompanied by the formation of solid oxides and gaseous sulfur oxide which is easily utilized. Termination of the oxidizing roasting is followed by comminution of the solid oxides, after which these oxides are mixed with the reducing metal viz., aluminum. The ratio between the oxides and reducing metal in the range 1:0.3–1:0.7 is determined by the quantity of exothermally reducible iron and silicon oxides present in the burden, and by the stoichiometric proportion of aluminum. The preferable combustion temperature during aluminothermy is 2000°–2300° C.

Subsequent to mixing, the aluminothermic burden is charged into a closed, but not airtight autoclave, and a short heat pulse is applied to initial combustion in the presence of atmospheric air. The rate of the combustion process here can be as high as 12 mm/s. After a wave of chemical reduction reaction the products of combustion, viz., ferrosilicon with additions and aluminum oxide (corundum), are in the liquid phase. Then they are separated due to a substantial difference in their density (~8 g/cm and ~4 g/cm, respectively), and crystallized.

The products obtained from the aforedescribed process can be utilized as abrasives (corundum), and as deoxidizing and modifying additions in metallurgy (ferrosilicon).

Described hereinbelow are specific examples for carrying out the method according to the invention.

EXAMPLE 1

Raw material in the form of wastes resulting from magnetic separation of sulfide ores composed of, in % by mass: $FeS_2$-14; $Fe_2O_3$-19; $SiO_2$-30; $Al_2O_3$-20; CaO-11, MgO-5, and less than one per cent in the total of Ti, Cr, Mn, Co and Zn oxides are dried and commiunted to a grain size less than 100 μm across. The percentage of additions as, Zn and Pb in the powder amounts to approximately 0.5%.

Then one kg of the powdered raw material is mixed with 150 g iron powder and 50 g calcium sulfate. The mixture is loaded into an oxygen-circulating autoclave to be thermally treated in an atmosphere of oxygen. Combustion is irritated at the autoclave end to which oxygen is admitted. In a combustion wave the temperature grows to 1500° C., and the wave propagates at a rate of 0.5 mm/8. Sulfur dioxide liberated during combustion is utilized for the production of sulfuric acid. Because the content of sulfur dioxide in gaseous products can be as high as 90–95%, this gas is utilized completely, and does not pose an environmental problem. Solid products resulting from the stage of oxidizing roasting, viz., oxides of iron, silicon, aluminum, calcium magnesium, and ingredient metals, have a composition suitable for the reduction stage, i.e., the "active ingredient" includes 552 grams of iron oxide and 300 grams of silicon oxide. At the second stage solid products are removed from the autoclave, comminuted to a grain size less than 100 m, and mixed with 300 g of aluminum powder. Apart from the active ingredient, the solid products of the first stage contain an "inert ingredient" in the form of 200 g aluminum oxide, 110 g calcium oxide, 50 g magnesium oxide, and 10 g of other metal impurities. Then the burden is mixed with aluminum, placed in a closed autoclave, and ignited. In the course of combustion and reduction of iron and silicon oxides by aluminum in an exothermic reaction and magnesium oxide in an endothermic reaction ingredient metals are recovered. Combustion promotes a temperature increase to about 2150° C., whereby all the components of the mixture are melted and separed. Liquid iron, silicon, and ingredient metals form ferrosilicon alloyed with titanium, manganese, vanadium, and zirconium in an amount of 525 g. The molten ferrosilicon is separated from molten slag of compound aluminum-calcium oxide thanks to its high density. Molten products of combustion have the form of an interfaced double-phase liquid. Slag overlies ferrosilicon. After cooling and crystallization the slag is easily separated from the ferrosilicon ingot. Magnesium recovered thermally by aluminum is evaporated and trapped in the condenser.

In this manner, one kg of the starting raw material referred to at the beginning of the example yields 150 g sulfur dioxide, 525 g ferrosilicon, 1010 g compound aluminum-calcium oxide in the form of refractory aluminuous clinker, and 30 g magnesium.

Examples 2 to 8 are summarized in Table 1.

All additions are given per one kg of the starting raw material.

TABLE 1

| Example No. 1 | Composition of raw material, mass %; particle size 2 | Type, quantity of additions in the burden; grain size 3 | Ratio (oxygen-containing compound): (chemical element); total quantity of additions, mass % 4 | Temperature of combustion in the first stage of oxidizing roasting, °C. 5 |
|---|---|---|---|---|
| 2 | $FeS_2$ ~8%<br>$Fe_2O_3$ ~8%<br>$SiO_2$ ~55%<br>$Al_2O_3$ ~10%<br>CaO ~8%<br>MgO ~4%<br>Ti, Cr, Ni Mn oxides, rare-earth metals, etc 5%;<br>As, Zn, Pb 0.5%<br>−100 μm | Chem. element-iron in the form of powdered cast iron wastes - 40%; −100 μm (oxygen-containing compound)-in the form of solid powdered oxides-products of combustion in first stage from previous experiments including: Fe O 40% SiO 25%; Al, Ca, Mg+ impurities 40%; −100 μm | 1:1<br>80% | 1450° C. |
| 3 | $FeS_2$ ~14%<br>$Fe_2O_3$ ~19%<br>$SiO_2$ ~30%<br>$Al_2O_3$ ~20%<br>CaO ~11%<br>MgO ~5%<br>Ti, Cr, Mn, Co, Zr oxides, rare-earth metals, etc. <1%;<br>−100 μm | (chem. elem.) -iron powder 198 g; 16.5%; −100 μm (oxygen-containing compound)-in the form of powdered calcium peroxide-1.9 g; 0.16% −100 μm | 1:101<br>16.7% | 1000° C. |
| 4 | $FeS_2$ ~8%<br>$Fe_2O_3$ ~8%<br>$SiO_2$ ~55%<br>Al2O3 ~10%<br>CaO ~8% | (chem. elem.) iron powder 200 g; −100 μm Oxygen-con- | 2:1<br>37.5% | 1800° C. |

TABLE 1-continued

| | | | | |
|---|---|---|---|---|
| | MgO ~4% Ti, Cr, Mn, Ni oxides, rare-earth metals, etc. <1%; −100 μm | taining chem. elem. in the form of powdered calcium peroxide 400 g; −100 μm | | |
| 5 | $FeS_2$ ~14% $Fe_2O_3$ ~19% $SiO_2$ ~30% $Al_2O_3$ ~20% CaO ~11% MgO ~5% Ti, Cr, Mn, Zr oxides, rare-earth metals, etc. <1%; −100 μm | (chem. elem.) iron powder 20 g, 1.9% −100 μm (oxygen-containing chem. elem.) calcium peroxide 20 g, 1.9% −100 μm | 1:1 3.8% | combustion dies down after initiation |
| 6 | $FeS_2$ ~14% $Fe_2O_3$ ~19% $SiO_2$ ~30% $Al_2O_3$ ~20% CaO ~11% MgO ~5% Ti, Cr, Mn, Co, Zr oxides, rare-earth metals, etc. <1%; −100 μm | (chem. elem.) iron powder 300 g; 22.5% −100 μm (oxygen-containing chem. element powdered calcium peroxide 30 g; 2.3%; −100 μm | 1:10 24.8% | 1570° C. |
| 7 | $FeS_2$ ~14% $Fe_2O_3$ ~19% $SiO_2$ ~30% $Al_2O_3$ ~20% CaO ~11% MgO ~5% Ti, Cr, Mn, Co, Zr oxides, rare-earth metals, etc. <1%; −100 μm | (chem. elem.) iron powder 400 g; 100 μm (oxygen-containing chem. element) - powdered product as in Example 2, 400 g; 100 μm | 1:1 44% | 1490° C. |
| 8 | Fe in the form of oxide 14.8% $SiO_2$ ~63.1% $Al_2O_3$ ~0.4% CaO ~3.1% Mg ~3.1% $TiO_2$ ~0.7% Na2O ~0.03% K2O ~0.03% S ~0.06% $CaO_2$ none; −100 μm | (chem. elem.) powdered cast iron 30%; −100 μm (oxygen-containing chem. compound) powdered solid oxides-products of combustion in first stage from previous experiments containing FeO ~40% SiO ~25% other oxides Al, Ca, Mg+ ingredient compounds 30%; −100 μm | 1:1 60% | 1410° C. |

| Example No. 1 | Characteristics of combustion products in first stage 6 | Ratio oxides (reducing metal) Al in second stage of the process 7 | Temperature of combustion in second stage (metallothermy), C 8 | Characteristics of products in the second stage of the process 9 |
|---|---|---|---|---|
| 2 | products obtained: SO + solid oxides; analysis: Fe gen. ≅37% Si gen. ≅13% O gen. ≅37% Mg gen. ~0.7% Ca gen. ~3% Al gen. ~2% residual sulfur <0.5%; good quality product, yield ~90%; As, Zn, Pb ~0.5% | 1:0.4 | 2280° C. | yield of product 95%; composition: corundum and calcium oxide ferroalloy; separation slag/ferro-alloy 94%; ferroalloy yield 30%; composition of ferroalloy: Fe ~75%. Al ~3%, Si ~15%; Mn, Cr, Ni, Ti ~40%; traces of rare-earth metals; quality optimum; As, Zn, Pb <0.1% |
| 3 | incomplete sulfur combustion; product unfit for further processing | | | |
| 4 | "deadborn" sintering of product occurred in oxidizing roasting; product unfit for further processing | | | |
| 5 | — | — | — | — |
| 6 | products obtained: $SO_2$ + solid oxides; analysis: Fe gen. 29% Si ~12% Mg ~0.8% Ca ~8% Al ~10% residual sulfur <1% | 1:0.28 | 1990° C. | combustion died down product failed to separate |
| 7 | products obtained: $SO_2$ +solid oxides; analysis: Fe gen. ~57% Si ~13% Mg ~0.7% Ca ~3% Al ~2% residual sulfur <0.5% | 1:8 | 2500° C. | all burden was ejected from the reaction volume |
| 8 | products obtained: $SO_2$ + solid oxides analysis: Fe gen. ≅37% Si ≅13% O ≅37% Mg ~0.7% Ca ~3% Al ~2% residual sulfur <0.5%; good quality product yield ~90%; As, Zn, Pb ~0.5% | 1:0.4 | 2280° C. | yield of products - 95% composition: corundum and calcium oxide + ferroalloy; separation slag/ferro-alloy ~94%; ferroalloy yield ~30%; composition of ferroalloy; Fe ~75%, Al 3%, Si ~15% ingredients: Mn, Cr, Ni, Ti ~40%, traces of rare-earth metals; optimum quality; As, Zn, Pb |

TABLE 1-continued

| | |
|---|---|
| | <0.1% |

It can be seen from Table 1 showing characteristics of the products in the second stage of the process that optimized relationship between the distinctive features of the proposed method allow the maximum yield of ferroalloy and corundum having a grain strength 200/160 and 160/125 μm, which is comparabel with the grain strength of artificial diamonds.

INDUSTRIAL APPLICABILITY

Products obtained by the proposed method can be industrially utilized for making sulfuric acid, alloying and deoxidizing additions, corundum and mullite corundum refractory materials, or high-alimina cements.

The method is friendly to the environment in spite of 100% processing of the starting raw material. The method is energy-efficient, and can be implemented in standard production equipment and controlled.

What is claimed is:

1. A method for obtaining selected metals, their compounds and their alloys as a target end-product from a mineral raw material containing the selected metals, the method comprising the steps of:

(A) preparing a burden by:

(i) comminuting the mineral raw material, (ii) adding to the comminuted raw material a chemical element present in the mineral raw material and selected from the group consisting of iron, manganese, nickel, chromium, titanium, aluminum, magnesium, calcium, silicon, and mixtures thereof, depending on the initial composition of the raw material, and (iii) adding to the comminuted raw material an oxygen-containing compound of a chemical element-compound selected from the group consisting of peroxides, magnetities, and mixtures thereof, as necessary to provide an oxygen-containing atmosphere, the ratio of the oxygen-containing compound additions to the chemical element-compound additions being from 1:1 to 1:100 by weight, and the combined chemical element-compound additions and oxygen-containing compound additions being at least 5% by weight of the burden;

(B) oxidizing roasting of the burden in an oxygen-containing atmosphere at a temperature of from 1400° to 1600° C., thereby producing intermediate solid product containing solid oxides and, as by-product gaseous oxides;

(C) evacuating and disposing of the gaseous oxides;

(D) comminuting the solid oxides; and (E) reducing the intermediate solid product with a reducing agent, depending on the chemical composition of the intermediate solid product and the target end-product, by mixing the reducing agent and the comminuted solid oxides, the ratio of the total comminuted solid oxides to the reducing agent being from 1:3 to 1:0.7, and the reduction process being performed at a temperature of from 2000° to 2300° C.

* * * * *